US006062908A

United States Patent [19]

Jones

[11] Patent Number: 6,062,908

[45] Date of Patent: May 16, 2000

[54] HIGH DENSITY CONNECTOR MODULES HAVING INTEGRAL FILTERING COMPONENTS WITHIN REPAIRABLE, REPLACEABLE SUBMODULES

[75] Inventor: Terrill H. Jones, San Diego, Calif.

[73] Assignee: Pulse Engineering, Inc., San Diego, Calif.

[21] Appl. No.: 09/010,203

[22] Filed: Jan. 21, 1998

Related U.S. Application Data

[60] Provisional application No. 60/034,870, Jan. 27, 1997, provisional application No. 60/048,008, May 29, 1997, and provisional application No. 60/060,671, Oct. 2, 1997.

[51] Int. Cl.[7] ..... H01R 13/66

[52] U.S. Cl. ..... 439/620; 439/490

[58] Field of Search ..... 439/620, 676, 439/941, 490

[56] References Cited

U.S. PATENT DOCUMENTS

| | | | |
|---|---|---|---|
| 3,422,394 | 1/1969 | Antes | 439/637 |
| 4,109,986 | 8/1978 | Mouissie | 439/637 |
| 4,461,522 | 7/1984 | Bakermans et al. | 439/62 |
| 4,695,115 | 9/1987 | Talend | 439/76 |
| 4,701,002 | 10/1987 | Mouissie | 439/426 |
| 4,726,638 | 2/1988 | Farrar et al. | 439/620 |
| 4,772,224 | 9/1988 | Talend | 439/607 |
| 4,995,834 | 2/1991 | Hasegawa | 439/620 |
| 5,015,204 | 5/1991 | Sakamoto et al. | 439/620 |
| 5,015,981 | 5/1991 | Lint et al. | 439/65 |
| 5,069,641 | 12/1991 | Sakamoto et al. | 439/620 |
| 5,139,442 | 8/1992 | Sakamoto et al. | 439/620 |
| 5,178,563 | 1/1993 | Reed | 439/676 |
| 5,239,748 | 8/1993 | Hamilton | 29/843 |
| 5,282,759 | 2/1994 | Sakamoto et al. | 439/620 |
| 5,397,250 | 3/1995 | Briones | 439/620 |
| 5,399,107 | 3/1995 | Gentry et al. | 439/676 |
| 5,403,207 | 4/1995 | Briones | 439/620 |
| 5,456,619 | 10/1995 | Belopolsky et al. | 439/620 |
| 5,475,921 | 12/1995 | Johnston | 29/878 |
| 5,587,884 | 12/1996 | Raman | 439/620 |
| 5,647,767 | 7/1997 | Scheer et al. | 439/620 |
| 5,687,233 | 11/1997 | Loudermilk et al. | 379/442 |
| 5,736,910 | 4/1998 | Townsend et al. | 333/181 |
| 5,766,043 | 6/1998 | Talend | 439/676 |
| 5,872,492 | 2/1999 | Boutros | 439/620 |
| 5,876,239 | 3/1999 | Morin et al. | 439/490 |

FOREIGN PATENT DOCUMENTS

| | | |
|---|---|---|
| 654865 A1 | 5/1995 | European Pat. Off. . |
| WO94/05059 | 3/1994 | WIPO . |

OTHER PUBLICATIONS

International Search Report re PCT/US99/08650; Date of Mailing of International Search Report: Aug. 3, 1999.

*Primary Examiner*—Khiem Nguyen
*Assistant Examiner*—T C Patel
*Attorney, Agent, or Firm*—Knobbe, Martens, Olson & Bear, LLP

[57] ABSTRACT

A connector module for mounting on a circuit board includes a housing and at least one plug-receiving opening for receiving an RJ-45 or other similar jack. Each plug-receiving opening includes contact portions that make electrical contact with individual conductors, e.g., twisted pair conductors, connected to the RJ-45 jack. A plurality of connection pins protrude from a bottom surface of the housing and facilitate mounting of the modular connector onto the circuit board. Protection/filtering circuitry, located within vertical space inside of the housing so as to reside adjacent the connection pins, electrically couples and minimizes the electrical distance between the contact portions associated with each plug-receiving opening and the plurality of connection pins. The protection/filtering circuitry includes at least one ring-shaped ferrite core. Light emitting diodes may also be included as an integral part of the module, but are mounted for viewing so as to be outside of the shielded portions of the module.

19 Claims, 6 Drawing Sheets

HIGH DENSITY CONNECTOR MODULES HAVING INTEGRAL FILTERING COMPONENTS WITHIN REPAIRABLE, REPLACEABLE SUBMODULES

This application claims the benefit of U.S. Provisional patent applications Ser. Nos. 60/034,870, filed Jan. 27, 1997; 60/048,008, filed May 29, 1997; and 60/060,671, filed Oct. 2, 1997.

BACKGROUND OF THE INVENTION

The present invention relates to connector modules, e.g., RJ-45 connector modules, and more particulary to connector modules that incorporate as an integral part thereof removable and/or repairable magnetic filtering, light emitting diode (LED) indicators, and isolation and protective components that enhance transceiver performance and reject common mode noise. Advantageously, the connector modules of the present invention utilize commonly-available RJ-45 connectors, are small and compact, have a footprint size that is no larger than or reduced from that which has heretofore been available for such modules, and facilitate repair and/or replacement (e.g., upgrades).

Modern communication and transmission systems, such as are commonly used in a Local Area Network (LAN), transfer vast amounts of digital data at increasingly faster rates over Unshielded Twisted Pair (UTP) copper cable or other suitable cables (e.g., fiber optic). The signal path for LAN devices is generally initiated by a silicon-based driver integrated circuit (IC). The signal generated by the IC driver passes through passive filtering devices to limit the frequency passband, and then through some isolation transformers, and then out of a connector onto a UTP cable. The connector of choice for many LAN applications used to interface with UTP cable (or other transmission cable) is referred to as an RJ-45 connector.

In recent years, a wide variety of RJ-45 connector modules have been employed to facilitate the connection between the IC driver, located on a printed circuit board (PCB) as part of some communication device or processor, and the UTP cabling, which cabling interconnects the various devices that form the LAN.

U.S. Pat. Nos. 4,695,115; 4,772,224; 5,015,204; 5,069,641; 5,139,442; and 5,397,250 are representative of the RJ-45, and similar (e.g., RJ-11), connector modules that have been used in the past for LAN and telephonic connections. As shown in these prior art patents, a module is provided for mounting on a PCB. The module includes a plug-receiving opening into which the desired jack, usually an RJ-11 or RJ-45 type jack, may be detachably inserted. The module has conductors included as an integral part thereof that connect each wire or pin of the RJ-11 or RJ-45 connector to a suitable pin or leg of the module. The pins or legs of the module are attached, e.g., soldered, to the PCB in conventional manner. Once mounted on a circuit board, the module thus provides a simple and easy way to connect and disconnect the RJ-11 or RJ-45 jack, which is usually connected to UTP or other multi-conductor cabling system, to electrical circuitry contained on the PCB.

In order to filter out noise and extraneous signals that may be present on or induced in the signals that pass through the connector modules, and in order to prevent extraneous ElectroMagnetic Interference (EMI) from being coupled into the signal lines that pass through the conductor, it is known in the art to employ filtering and EMI protection circuitry adjacent the connector module. Such filtering and/or EMI protection circuitry traditionally places discrete filtering components on the printed circuit board near the connector module.

Placing discrete filtering components on the printed circuit board near the connector module not only consumes valuable space, but also sacrifices performance and adds unnecessary complexity to the design and number of components that must be used to realize the circuitry. What is needed, therefore, is a connector module which incorporates the desired filtering and protection circuitry within the connector module itself, and which thereby frees up additional board space for other needed circuit componentry, and/or allows the overall circuit board size to be smaller.

Some of the connector modules known in the art do attempt to incorporate protection, isolation and/or filtering circuitry within the module housing itself. However, such modules tend to be larger (have a larger "footprint") than do modules without such circuitry, and/or the amount of filtering, isolation and protection provided by such "built-in" components lacks sufficient capability to adequately perform the needed protective, isolation and filtering functions. Further, connector modules modified to include such isolation and/or filtering circuitry typically require extensive tooling changes that are expensive and difficult to realize. What is thus needed is a connector module that has built-in or integral isolation, filtering and protective circuitry and which offers the needed isolation/protection/filtering performance sophistication demanded by today's high speed LAN or other signal transmission and communication protocols, yet does not increase, and may even reduce, the PCB footprint required for such module. In addition, it is important that such connector module be fully compatible with existing connectors.

It is also known in the art to employ light emitting diodes (LEDs) in conjunction with an RJ-45 connector module to provide a visual indication that data is being transmitted through the cable connected to the connector to or from circuitry located on (or coupled to) the PCB on which the connector module is mounted. Such LEDs are typically used in pairs, with one LED indicating whether data is being received through the RJ-45 connector module (from a source remote from the PCB), and the other LED indicating whether data is being transmitted out through the RJ-45 connector module. Sometimes different colors, e.g., red, green or yellow, may to use to signify different events or non-events relative to the data trasnfer. For example, the color red may be used to visually indicate that no data is being received or transmitted through the connector module, while the color green may be used to visually indicate that data is being received or transmitted through the connector module. Unfortunately, the use of such LEDs within a connector module creates its own set of problems. Not only might the footprint size of the module increase when LEDs are used, but the electrical current flowing through the wires that drive the LEDs may itself be a source of electrical noise that is coupled into the signal lines passing through the connector module. Hence, it is evident that what is needed is a connector module having LED indicators as an integral part thereof, but wherein the use of such LED indicators does not increase the footprint size, and does not function as a source of electrical noise.

SUMMARY OF THE INVENTION

The present invention addresses the above and other needs by providing a connector module, e.g., a RJ-45 connector module, which includes, as an integral part thereof, the requisite isolation, filtering and protection circuitry demanded by modern high performance LAN and other communication systems. Optimum performance is achieved in the passive isolation/protection and filtering circuitry using, e.g., inductors and transformers wound on ferrite cores, thereby providing what is commonly referred to as "magnetic filtering". In accordance with one important aspect of the invention, such magnetic filtering may be provided in a removable, repairable submodule housed within the main connector module. Additionally, the module of the present invention is configured such that its overall "footprint" (i.e., the area required to mount the module on a circuit board) is generally no greater than, and may be less than, the footprint provided by unfiltered connector modules currently available on the market wherein magnetic components are combined or included within the module. Moreover, the present connector module uses standard, commonly-available jacks, e.g., RJ-45 jacks, without the need for expensive modifications.

In accordance with one aspect of the invention, one, two, three, four or more RJ-45 jacks may be received into a single multiple jack connector module.

In accordance with another aspect of the invention, a multiple jack connector module is configured in a vertical stack arrangement so as to exhibit a very small footprint. For example, a dual vertical model of the invention has the capacity for receiving two RJ-45 jacks, one above the other, in a footprint size that is typically much less than, and certainly no greater than, the footprint of a prior single RJ-45 connector module. Similarly, a triple vertical model, or quad vertical model, have the capacity for receiving three or four RJ-45 jacks, respectively, one above the other, with the same small footprint as the dual or single model. In addition, as will be evident from FIGS. 8, 9 and 10, discussed below, these multiple vertical jack connector modules provide an improved magnetic placement, i.e., placement of the magnetic filtering components, that is different from, and better than, the traditional "step and repeat" type patterns of the prior art. In the prior art, each module of a vertical stacked module is simply a repeat of the module underneath it, hence, the term "step and repeat". In accordance with the present invention, however, the isolation components for all the connector modules in the stack are placed near the bottom, or data entry point, while the filtering components are placed near the pins of the RJ-45 connector for the applicable connector. Further, one embodiment of the invention provides a removable submodule within the main connector module wherein the magnetic filtering elements for a vertical stack are housed. Because the submodule is removable, repair and/or replacement, e.g., upgrading, of the connector module is made much easier and less costly than has heretofore been possible. Moreover, the submodule configuration advantageously minimizes adjacent channel crosstalk.

In accordance with yet an additional aspect of the invention, the "magnetic filtering" components used within the connector module (sometimes referred to herein as simply the "magnetics"), which components typically include ferrite cores on which inductors and transformers are wound, are housed within the connector module so as to occupy available vertical space within the housing, e.g., adjacent the surface of the board on which the connector module is mounted, or as close thereto as possible, thereby minimizing the distance between such circuit components and associated conductive traces on the circuit board. Minimizing this distance is important because the wires and conductors employed within the module, and on the printed circuit board, can, at sufficiently high frequencies, readily pick up unwanted noise and other interfering signals. The longer the interconnect distance, the more noise and/or EMI that may be picked up. Thus, because the interconnect distance, referred to herein as the "electrical distance", between the filter and the connector allows for such unwanted coupling of high frequency "noise" and EMI into the conductors that feed the UTP copper cable, it is desirable to reduce this electrical distance as much as possible. (Note: once UTP cable is encountered, the twisting of the conductor pairs generally prevents such unwanted noise and EMI from being induced into the cable. However, it is the circuit runs and conductor lengths on the printed circuit board and/or within the connector module that become problematic.) Such electrical distance minimization provided by the invention advantageously eliminates many of the problems associated with prior art connector modules that have heretofore always been used in combination with a "magnetics" module mounted on the PCB adjacent the connector module.

In accordance with still another aspect of the invention, LEDs may form an integral part of the connector module. Such LEDs may be mounted, e.g., on the PCB that contains the magnetics, allowing integration of the LED function without violating the shielded space within the connectors. When necessary, light pipes may be used to couple the light from the LEDs to a desired location adjacent or near the connector opening.

One embodiment of the invention may thus be characterized as an improved connector module. The connector module includes a housing having a plug-receiving opening, opposed top and bottom surfaces joined by opposed side surfaces extending from the opening to a back surface, and a plurality of elongated contacts mounted to the housing, each contact including a contact portion at one end extending diagonally into the opening, and a connecting portion electrically coupling the contact portion through protection/filtering/isolation circuitry contained within the housing to at least one of a plurality of pins that protrude from a bottom surface of the housing. The pins provide a means for mounting the modular jack connector on a circuit board and for making electrical contact with circuit traces on the circuit board. The improvement provided by the invention comprises positioning the protection/filtering/isolation circuitry, which includes at least one ferrite core, within available vertical space within the housing, i.e., between the plug-receiving opening and the bottom surface of the housing, so as to minimize the electrical distance between the protection/filtering/isolation circuitry and the plurality of pins at the bottom surface of the housing. LEDs may also be included as part of the connector module.

Another embodiment of the invention may be characterized as a connector module adapted for mounting on a circuit board. The connector module includes a housing and at least one plug-receiving opening for receiving an RJ-45 or other similar jack. Each plug-receiving opening includes contact portions that make electrical contact with individual conductors, e.g., twisted pair conductors, connected to the RJ-45 jack. A plurality of connection pins protrude from a bottom surface of the housing and facilitate mounting of the modular connector onto the circuit board. Passive isolation, protecting, filtering and LED circuitry is included in the connector module. Such circuitry includes at least one ring-shaped ferrite core to effectuate the requisite filtering, isolation and protection. Such circuitry is positioned within the housing so as to reside in available vertical space adjacent the connection pins, thereby minimizing the electrical distance between the PCB and the RJ-45 or other similar jack. The LEDs may also be mounted in or on the available vertical space, with light pipes being used, as needed, to carry the emitted light to a desired viewing port near the plug-receiving opening.

Other embodiments of the invention, as well as variations of the embodiments just described, will be evident from the more detailed description of the invention presented below.

It is a feature of the present invention to provide a connector module that provides improved performance over that achieved with existing connector modules.

It is a further feature of the invention to provide a connector module that exhibits a reduced footprint size.

It is another feature of the invention, in accordance with a vertical stack embodiment thereof, to provide multiple jack connector modules that facilitate connection with one, two, three, four or more jacks in a multi-jack connector module having a reduced footprint.

It is still an additional feature of the invention to provide an enhanced connector module utilizing commonly-available connectors wherein the magnetics are packaged within the module so as to minimize the electrical distance between the magnetics and the conductors on the surface of the circuit board.

It is yet another feature of the invention to provide a connector module that includes LEDs as an integral part thereof, which LEDs are mounted on the PCB that contains the magnetics, thereby preventing any violation of the shielded space within the connectors (i.e., thereby avoiding any possibility that the LEDs themselves might function as a noise source within the connector module.

It is still an additional feature of the invention to provide a connector module wherein the magnetics may be packaged in such a way that easy replacement of defective components or upgrading to new components or modules can be easily achieved, e.g., through socket mounting, soldering, removal and/or replacement of submodules, or plugging into a common PCB. Such replaceability not only enhances the module for easy upgrade, but also facilitates field repair.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
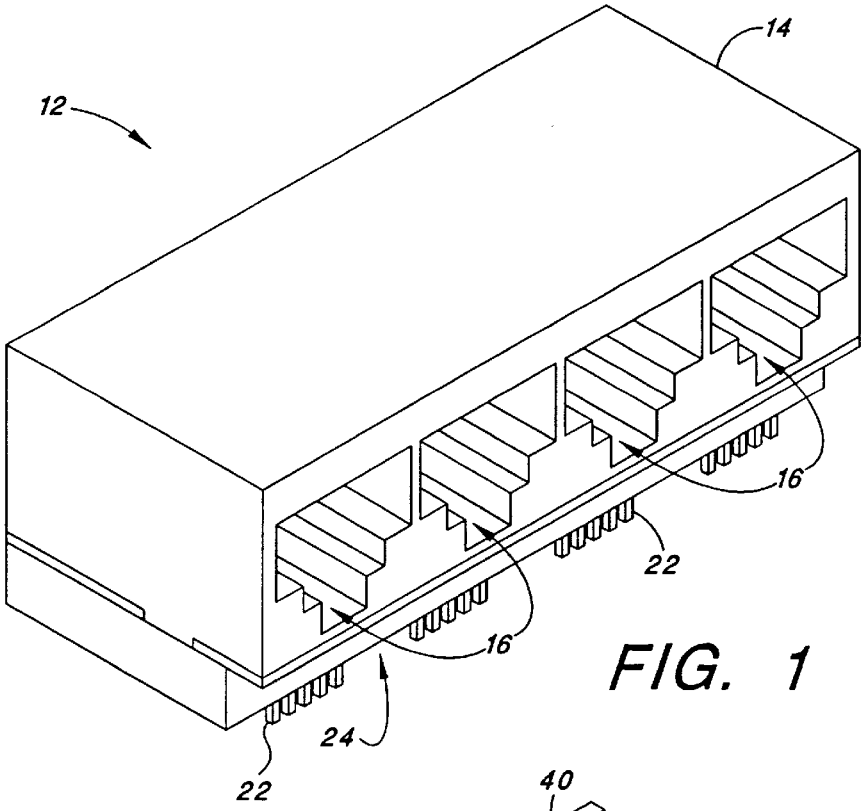
FIG. 1 shows a perspective view of a quad horizontal connector module made in accordance with the present invention.
Figure 3:
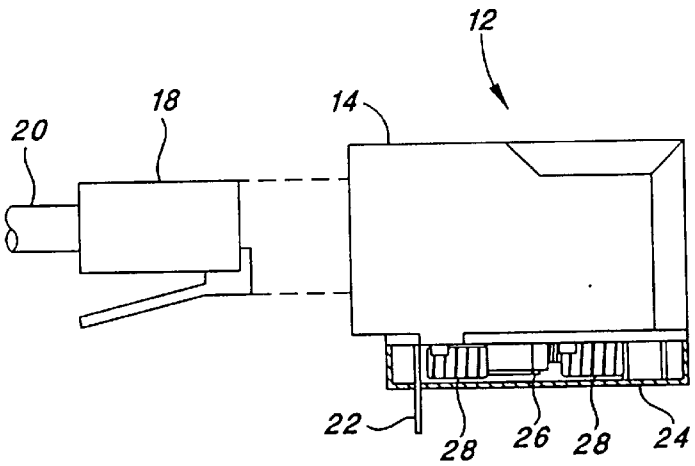
FIG. 3 is a side view of the quad horizontal connector module of FIG. 1.
Figure 2:
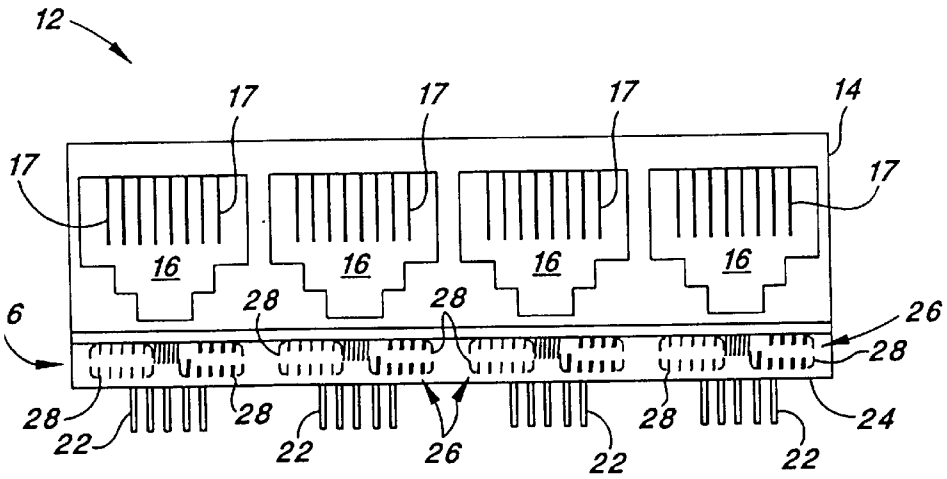
FIG. 2 is a front view of the quad horizontal connector module of FIG. 1.

Turning first to FIGS. 1, 2 and 3, a perspective, front and side view, respectively, on one type of connector module 12 made in accordance with the present invention is shown. The type of connector module shown in FIG. 1 may be characterized as a quad horizontal module. Such module includes a housing 14 and at least one plug-receiving opening 16 for receiving an RJ-45 jack 18 (FIG. 3). For the quad horizontal model shown in FIGS. 1614 3, four plug-receiving openings 16 are employed within a single housing 14, each opening being positioned horizontally adjacent another opening. Each opening 16 includes a plurality of contact portions 17 adapted to contact corresponding electrodes of the RJ-45 jack 18. A conventional RJ-45 connector has eight such contact portions 17, each adapted to contact one of eight corresponding electrodes that are included as part of the RJ-45 jack 18. The RJ-45 jack 18, as well as the plug-receiving openings 16, are of conventional design. The RJ-45 jack 18 is connected to a cable 20, e.g., a UTP cable, which is connected to a LAN or other network which interconnects a family of data processing devices, e.g., personal computers, one or more servers, terminals telephones, printers, facsimile machines, etc.

A plurality of connection pins 22 protrude from a bottom surface 24 of the housing 14. These pins 22 are adapted for insertion into a circuit board (not shown). Protection/filtering circuitry 26 electrically couples the contact portions associated with each plug-receiving opening 16 to at least one of the plurality of connection pins 22, as seen from the schematic diagram of FIG. 6, discussed below. The protection/filtering circuitry 26 includes at least one ring-shaped ferrite core 28 having two or more wires separately wound therearound. Use of ferrite cores 28 allows efficient and compact isolation transformers, and inductors, to be included within the circuitry 26. Note that two ferrite cores 28 are visible in FIG. 2 as part of the protection/filtering circuitry 26 associated with each plug-receiving opening 16. In practice, four or more such ferrite cores 28 may be used as part of each circuit.

An important feature of the invention, as shown in FIGS. 1–3, is the positioning of the passive circuitry 26 in the available vertical space within the housing 14, e.g., between the plug-receiving openings 16 and the pins 22. Such positioning advantageously minimizes the electrical distance between the pins 22 and the contact portions 17, thereby reducing the amount of noise that may be coupled into the system, and improving the system's immunity to EMI.

Figure 7:
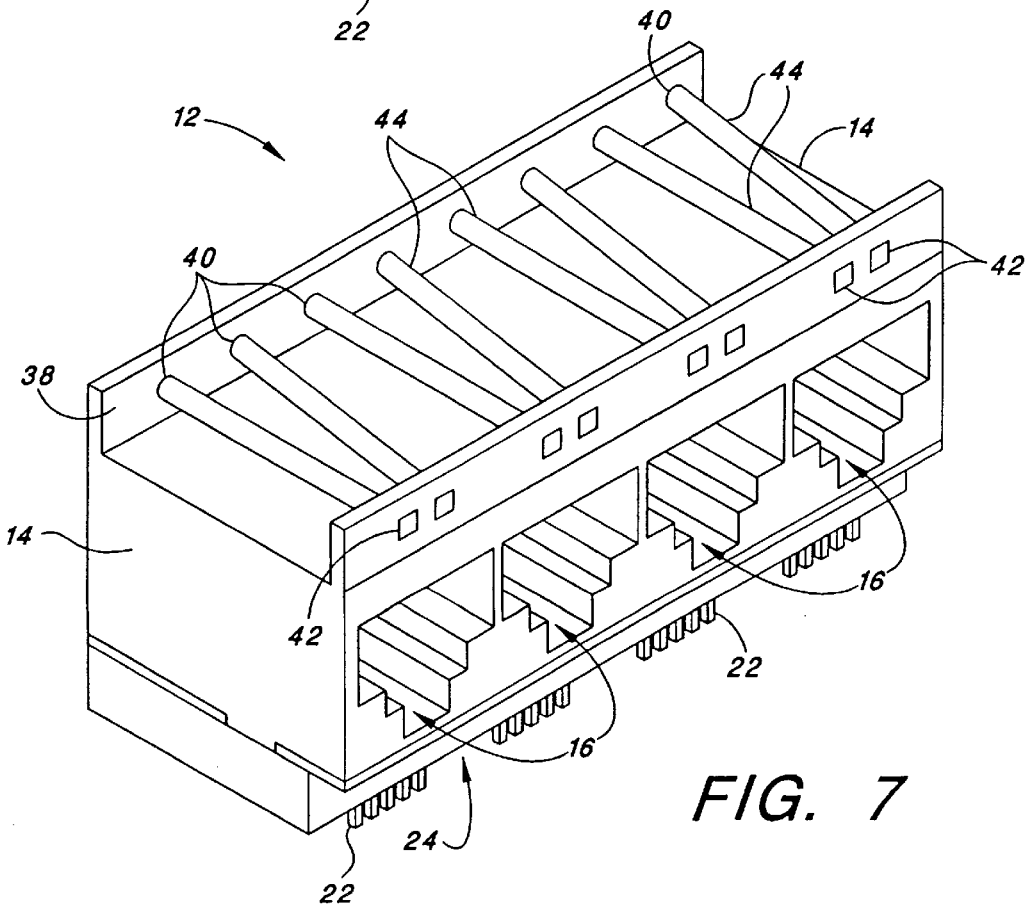
FIG. 7 is a perspective view of a quad horizontal connector module, as in FIG. 1, but wherein the module also includes surface-mount LED's connected to the back plane PCB, outside of the shielded area within the connector openings 16, with light pipes coupling the emitted light from the LED's to viewing ports on a front plane of the connector.

Referring momentarily to FIG. 7, an alternative embodiment of the invention is shown. In the embodiment shown in FIG. 7, a perspective view of a quad horizontal connector module 12 is shown, as in FIG. 1, but the module 12 further includes surface-mount LED's 40 connected to a back plane PCB 38 of the module. Importantly, the LED's 40 are mounted outside of the shielded area inside of the connector openings 16, thus greatly minimizing, if not totally eliminating, the possibility that the LED's themselves might serve as a source of noise that could corrupt the data signal lines within the module opening. Conventional light pipes 44 may then be used to couple the emitted light from the LED's 40 to corresponding viewing ports 42 on a front plane 41 of the connector 12. As needed or desired, the unshielded area through which the light pipes 44 pass, may be covered with appropriate panels, so that from the outside, the module 12 appears as a single whole.

Figure 5:
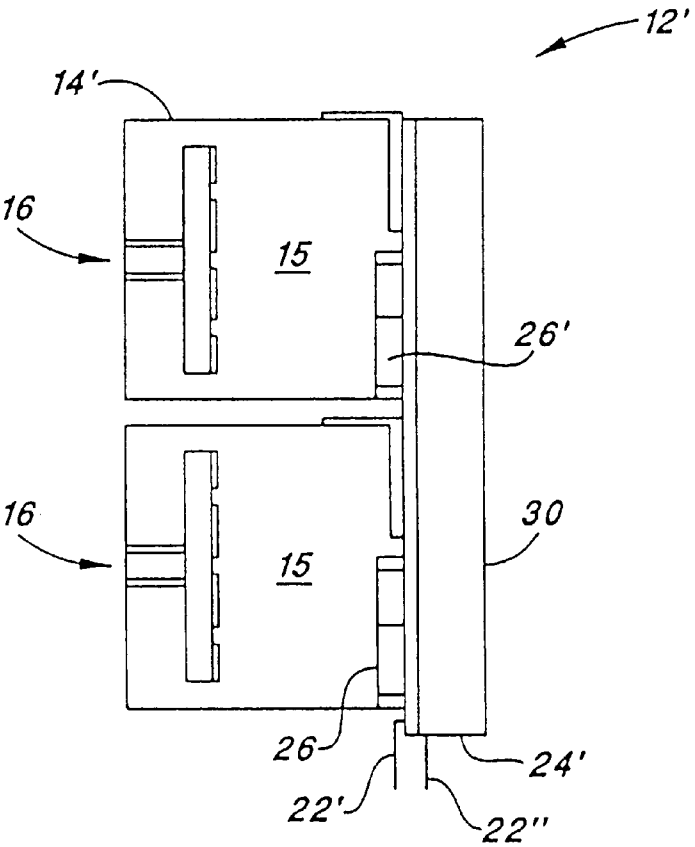
FIG. 5 is a side view of the dual vertical module of FIG. 4.
Figure 4:
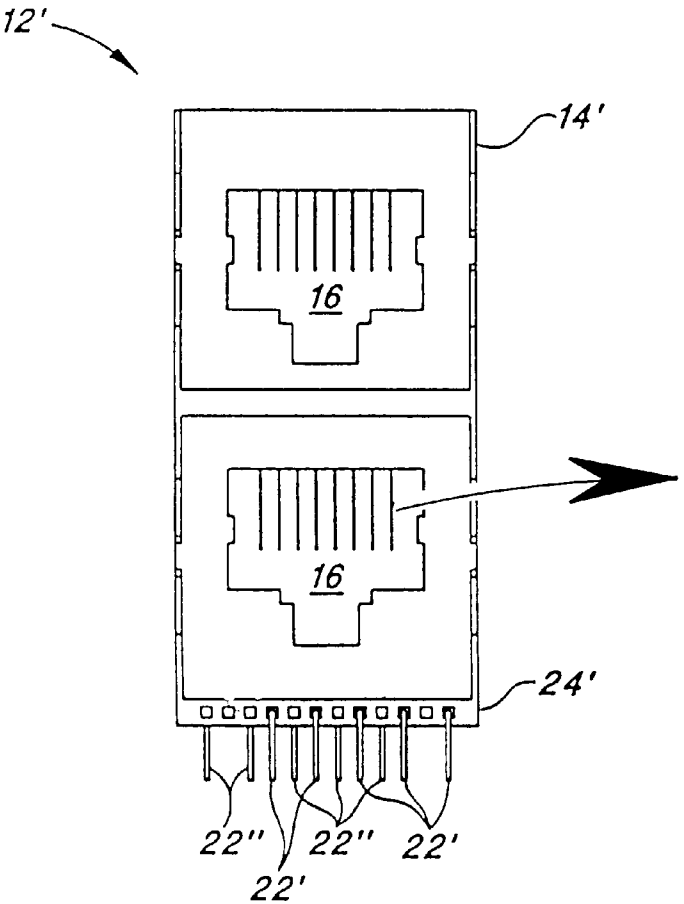
FIG. 4 is a front view of a dual vertical connector module made in accordance with the present invention.

Referring next to FIGS. 4 and 5, another embodiment of the invention is illustrated. More particularly, FIG. 4 shows a front view of a dual vertical model of a connector modual 12' made in accordance with the present invention. FIG. 5 illustrates a side view of the dual vertical model 12'. In such dual vertical model 12', two plug-receiving openings 16 are stacked vertically, one on top of the other, in respective compartments 15, within a module housing 14'. Each compartment 15 is fastened to a main vertical trunk portion 30. Connector pins 22' and 22" are positioned in two rows along a bottom portion 24' of a main trunk portion 30. One row of five pins 22', e.g., a front row, corresponds to a first one of the plug-receiving openings 16, while another row of five pins 22", e.g., a back row, corresponds to a second one of the plug-receiving openings 16. Note that the pins 22' and 22" are not frontally aligned with each other, there being gaps between them such that from a front view, as seen in FIG. 4, all ten pins of both rows are visible. While only two plug-receiving openings 16 in respective compartments 15 are illustrated in FIGS. 4–5, it is to be understood that additional plug-receiving openings 16 and compartments 15 may also be stacked in a similar manner, e.g., to provide a triple vertical model (three plug-receiving openings 16 vertically stacked on top of each other), a quad vertical model (four plug-receiving openings vertically stacked on top of each other), and the like. For a triple model, another row of pins 22 may added across the bottom 24' of the trunk portion 30. Alternatively, the five pins required for the additional port could be interspaced within the first and second rows of pins 22 already present. For a quad model, yet another row of pins 22 could be added, making a total of four rows of pins across the bottom 24' of the trunk portion 30 of the housing 14'; or, alternatively, the five additional pins associated with the forth port could also be interspaced within the first and second rows of pins already present.

Assuming the plug-receiving openings 16 are designed to receive an RJ-45 jack, which is what is depicted in FIGS. 4 and 5, there are eight contact portions 17 that extend diagonally into each opening (in a conventional manner for an RJ-45 connector) in order to make electrical contact with eight corresponding electrode portions of the RJ-45 jack that is inserted into the plug-receiving opening. These eight contact portions 17 are coupled to one of the rows of pins 22 across the bottom of the main trunk portion 30 of the housing 14' through electrical filtering/isolation circuitry 26, which circuitry takes the form illustrated in the schematic diagram of FIG. 6. The circuitry 26 is positioned within appropriate vertical space of the housing 14', typically to be as close as possible to the UTP connection. For example, in one variation, such circuitry 26 is placed within the main trunk portion of the housing 14' as close to the bottom 24' of the housing 14' as possible. In another variation, the circuitry 26 is placed toward the lower rear of each compartment 15 of the stack, and the main trunk portion includes a twisted pair bus structure, to electrically connect the circuitry 26 to the pins 22.

A key feature of the vertical stacked embodiment shown in FIGS. 4 and 5 is the extremely small footprint that such module provides. Because of the manner in which the compartments 15 extend out from the main trunk portion 30, in the same manner as branches extend from the trunk of a tree, the footprint of the connector module 12' is effectively only the area of the bottom surface 24' of the trunk portion 30. For the RJ-45 embodiment illustrated in FIGS. 4 and 5, the dimensions of such area are only about 5.1 mm by 18.2 mm (0.20 inches by 0.715 inches). Such a small footprint is made possible because of the vertical stacking of the compartments 15 used within the module 12'.

Note that other dimensions associated with the vertical stack model of the connector module of the present invention are also shown in FIGS. 4 and 5. These dimensions are shown in millimeters (mm), with the equivalent dimension in inches being shown within brackets [ ]. Thus, as seen in FIGS. 4 and 5, the overall height of the dual vertical model connector module 12' is approximately 36.8 mm [1.45 inches], the width is about 18.2 mm [0.715 inches], the depth is about 17.0 mm [0.67 inches], and the footprint is, as indicated above, only about 5.1 mm by 18.2 mm. The horizontal spacing between the pins 22' (or 22") is typically 1.27 mm, while the length of the pins 22' (or 22") ranges from about 3.0–4.6 mm. A vertical space of approximately 1.27 mm exists between the vertically stacked compartments 15.

Not only does the packaging illustrated in FIGS. 4 and 5 allow the magnetics to be as close as possible to the appropriate jack, while providing an extremely small footprint, but the density of the system equipment (in terms of ports per square inch, where a "port" is a plug-receiving opening 16 into which an RJ-45 jack can be inserted) is basically doubled (for the dual vertical model shown in FIGS. 4 and 5), tripled for a triple vertical model, or quadrupled (for a quad vertical model) over that which has heretofore been available in a single port module. This low density is made possible because not only are the magnetics moved as close as possible to the appropriate jack, but the magnetics are moved either behind the jack in available vertical space, or under the jack in the available vertical space, and vertical space is much less an issue (i.e., there is generally more vertical space to work with) than is PCB space.

Advantageously, the connector module of the present invention utilizes standard off the shelf RJ-45 connector jacks and standard RJ-45 plug-receiving openings 16, but couples the magnetic filtering/isolation as close as possible to the UTP connection. This configuration offers the best possible EMI performance.

Figure 9:
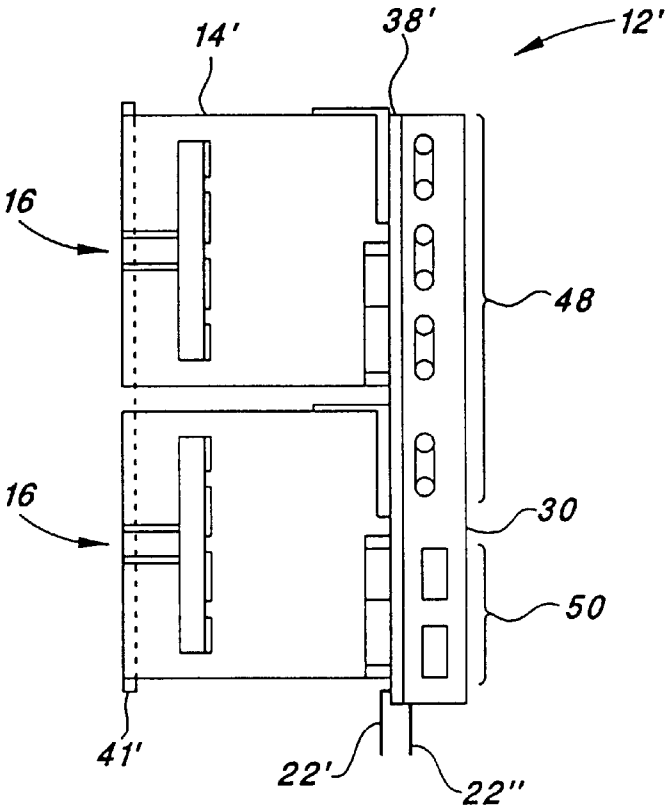
FIG. 9 is a side view of the dual vertical module shown in FIG. 8, further illustrating the positioning of the filtering chokes and isolation components on the back plane PCB.
Figure 8:
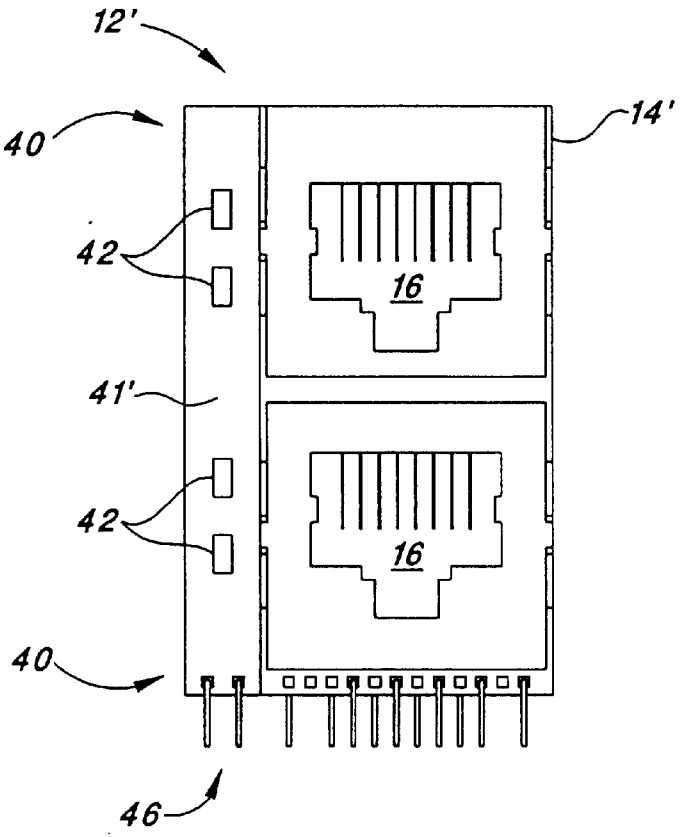
FIG. 8 is a side view of a dual vertical connector module, as in FIG. 4, but further including LEDs and viewing ports, similar to FIG. 7.

Referring next to FIGS. 8 and 9, an alternative embodiment of the vertical stacked connector module 12' of FIGS. 4 and 5 is depicted. The embodiment shown in FIGS. 8 and 9 is the same as that shown in FIGS. 4 and 5 with the addition of LED's 40 and viewing ports 42 in a front panel 41' along one side of the connector openings 16. The LED's 40 are not visible in FIG. 8, but it is to be understood that such LED's are positioned behind the viewing ports 42, mounted to a back plane PCB 38', which forms part of the trunk portion 30, and are optically coupled to the viewing ports 42 by use of a light pipe 44, or similar or equivalent optical structure, as taught in FIG. 7. It is also to be understood, that the LED's 40 could actually be mounted on the front panel 41'. Other than the requirement that the LED's not be mounted within the shielded portion of the connector 12', the precise location that the LED's are mounted, and the manner of coupling emitted light from the LED's to a suitable viewable location, is not critical. Mounting pins 46, along a bottom edge of the front panel 41', provide an electrical connection for coupling the LED drive signals to the LED's.

The side view of FIG. 9 further illustrates the preferred positioning of the magnetic and other components on the back plane PCB 38'. In particular, the magnetic filtering components 48 are preferably positioned as close a possible to their respective connector openings 16, i.e., immediately behind such openings. Thus, the filtering components associated with the top opening are positioned near the top opening, while the filtering components for the bottom opening are positioned near the bottom opening. Such positioning keeps the electrical distance between the pins within the opening 16 to a minimum. The isolation components 50 for the openings, in contrast, are preferably positioned as close as possible to the module's front mounting pins 22' and rear mounting pins 22", near the bottom of the module.

Advantageously, the connector modules of the present invention may be mounted to a PCB using any conventional technique, e.g., socket or plug mounted, thereby facilitating their easy upgrade or replacement. Alternatively, to improve reliability, the modules may simply to soldered to the PCB. Soldered modules may still be removed from the PCB for upgrading and/or field replacement, with a little more effort. This same concept applies to the manner in which the magnetic components are mounted to the back plane PCB, or other PCB. That is, an appropriate mounting technique may be used to facilitate upgrades and field replacements.

Figure 10:
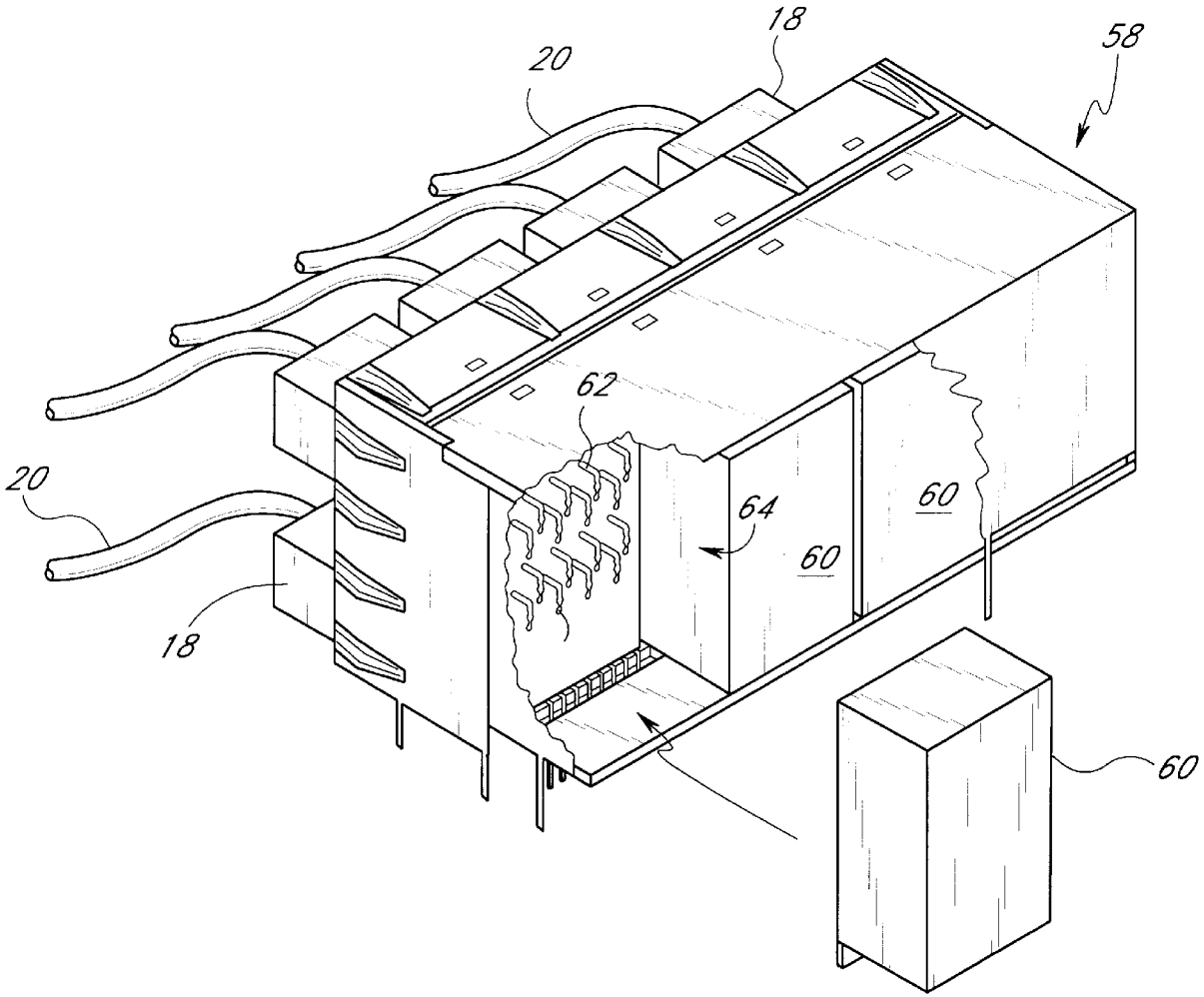
FIG. 10 illustrates an alternative embodiment of the invention wherein removable, repairable filtering (magnetic) submodules are employed for each vertical stack within a quad dual vertical stack.

For example, as shown in FIG. 10, the magnetic filtering and protective components of the invention are not only housed as described above in connection with FIGS. 8 and 9, but the components for each vertical stack are housed within their own, respective, removable submodule 60. FIG. 10 illustrates a quad dual stack connector module 58 made in accordance with the invention, wherein a portion of the connector module housing 58 is cut-a-way to show the positioning of the submodules 60. As with the connector module shown in FIGS. 8 and 9, the magnetic filtering components 48 are preferably positioned as close a possible to their respective connector openings 16, i.e., immediately behind such openings. Thus, the filtering components associated with a top or upper opening are positioned near the top opening, while the filtering components for the bottom or lower opening are positioned near the bottom opening. Such positioning keeps the electrical distance between the pins within the opening 16 to a minimum. The isolation components 50 for the openings, in contrast, are preferably positioned as close as possible to the module's front mounting pins and rear mounting pins, near the bottom of the module. The submodule 60 is snapped into position within the main housing 58, with electrical connection to the magnetic and filtering components housed within the submodule 60 being achieved with connection fingers 62, each having a spring-loaded tip 63, that protrude into a submodule opening 64 so as to make contact with appropriate contact points on the back side of the submodule 60.

Advantageously, the embodiment shown in FIG. 10 allows the integration of magnetic filtering and isolation functions in close proximity to the cable terminations for high density interconnect systems. It is to be understood that the quad dual stack connector 58 seen in FIG. 10 is only one example of such high density interconnect systems. As shown in FIG. 10, the design segregates the magnetic components into a vertical stack submodule 60 that services two ports, an upper port and a lower port. The submodule is easily snapped into or out of the main connector housing 48. This allows any segment to be easily replaced or upgraded in the field. In addition, because each submodule services a dual vertical stack, the submodule housing increases the available shielding between adjacent vertical stacks, thereby minimizing adjacent channel crosstalk.

Figure 6:
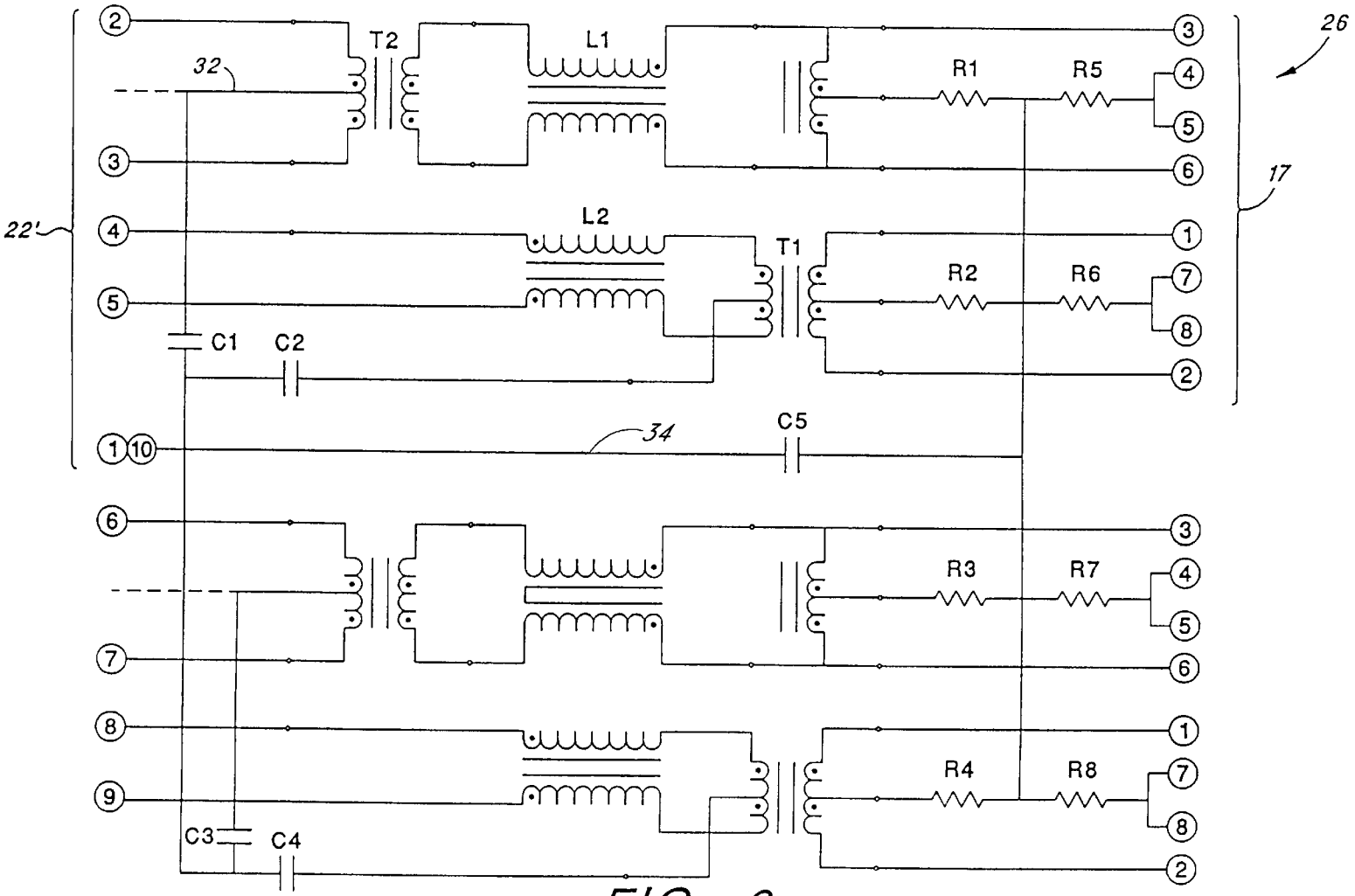
FIG. 6 is an electrical schematic diagram of the magnetics (i.e., protection/filter circuitry) included within the module of FIG. 4.

Turning next to FIG. 6, a schematic diagram of the isolation/protection/filtering circuitry 26 employed in the connector modules 12 or 12' or 58 of the present invention is illustrated. All such circuitry is effectively within a shielded area. Such circuitry does not include the circuitry for driving the LED63 s 40, as such circuitry is by design not to be included within the shielded area. Such LED-driving circuitry is conventional, and does not form part of the invention, per se.

The circuit shown in FIG. 6 includes the circuitry 26 for a dual connector module, i.e., a connector module having two plug-receiving openings or ports for receiving two RJ-45 connector jacks, like the dual vertical model shown in FIGS. 4 and 5. Thus, the circuitry shown at the top portion of the schematic relates to the protection/isolation circuitry 26 used with one of the ports 16, and the identical circuitry at the lower portion of the schematic relates to the protection/isolation circuitry 26 used with another of the ports 16. Because the lower and upper portions of the schematic are identical, only the top portion will be described, but it is to be understood that this explanation also applies to the bottom portion.

On the right side of FIG. 6, the eight connections, labeled with numbers 1–8 in circles, represent the eight contact portions 17 of the RJ-45 connector module, adapted to contact the eight electrode contacts of an RJ-45 jack. Similarly, on the left side of FIG. 6, the five connections, also labeled with numbers 1–5 in circles, represent the five pins 22, 22' or 22", adapted to be inserted into a PCB.

The circuitry shown in FIG. 6 includes isolation transformers T1 and T2 (which provide signal isolation, and hence protection) for the signals passing therethrough, and magnetic filtering components L1 and L2, which set a specific passband frequency that only allows signals within the passband to pass therethrough unattenuated. In general, input signals originating from a source connected to the UTP cable, enter pins 17-3 and 17-6 on the left side of the schematic, are filtered by filter L1, and then pass through isolation transformer T2 to pins 22'-2 and 22'-3 on the PCB side of the connector module. In a similar manner, signals originating on the PCB side of the connector enter PCB pins 22'-4 and 22'-5 on the left side of the schematic, are filtered by filter L2, and then pass through isolation transformer Tl to contact pins 17-1 and 17-2 on the right side of the schematic. A center tap of the PCB side of transformer T2 is connected to a first shield line 32, which first shield line may be connected to a conductive cover of the housing 14 or 14'. This conductive cover electrically shields all of the components therewithin. A center tap of the PCB side of transformer T1 is connected through serially-connected capacitors C2 and C1 to this same shield line 32.

As seen in FIG. 6, a secondary winding on the RJ-45 jack side of transformer T1 is also connected to pins 17-3 and 17-6. A center tap of this secondary winding is connected through serially-connected resistors R1 and R5 to both contact pins 17-4 and 17-5. similarly, the other winding on the RJ-45 jack side of transformer T1, which is connected to contact pins 17-1 and 17-2, has a center tap that is connected through serially-connected resistors R2 and R6 to contact pins 17-7 and 17-8. The R1-R5 junction, as well as the R2–R6 junction are connected together and to a second shield line 34. The second shield line 34 connects through capacitor C5 to PCB pin 22'-1.

The manner in which the magnetic filtering and isolation transformers shown in FIG. 6 operate in order to provide their filtering (passband) and isolation and/or protection functions is known in the art. Hence, no attempt will be made herein to further explain the theory of operation of the circuit 26. Suffice it to say that the passband filter limits the frequency passband, and the isolation transformer provides dc isolation and hence protection between the PCB side of the connector module (the side on which pins 22' are located) and the RJ-45 connector side of the module (the side on which the RJ-45 contact pins 17 are located).

The component values and/or component parts for the various elements shown in FIG. 6, for a preferred embodiment, are as shown in Table 1 below. It is to be emphasized that the component values shown in Table 1 are only exemplary, and that the invention extends to circuit configurations and component values other than those shown in FIG. 6 and/or Table 1 that provide the same aspects, features and advantages as does the present invention.

TABLE 1

Description of Components in FIG. 6

| Reference | Value | Comment |
|---|---|---|
| R1, R5 | 75 Ω | |
| R2, R6 | 75 Ω | |
| C1 | 0.1 μF | |
| C2 | 0.1 μF | |
| C5 | 0.01 μF | 2 KV working voltage |
| T1 | Isolation Transformer | Ferrite Core Part No. 36T01 available from Steward. 1:1 turns ratio |
| T2 | Isolation Transformer | Ferrite Core Part No. 36T01 available from Steward. 1:1 turns ratio |
| L1 | Magnetic Common Mode Choke | Ferrite Core Part No. 11-545-J, available from Ferronics. |
| L2 | Magnetic Common Mode Choke | Ferrite Core Part No. 11-545-J available from Ferronics. |

The connector modules 12, 12' of the present invention provide a versatile, adaptable building block for interfacing devices on a LAN or other similar network. Such modules are adaptable for 10/100TX applications, are shielded to offer the best possible EMI performance, provide minimal footprint space, have unused pairs terminated in the characteristic impedance, are gangable for multiport applications, exhibit preferred magnetics for common 10/100 transceivers, and exhibit integrated common mode noise management. Moreover, the TX and RX magnetics meet the IEEE 802.3 specification of 350 μH inductance for baseline wander error resistance.

While the invention herein disclosed has been described by means of specific embodiments and applications thereof, numerous modifications and variations could be made thereto by those skilled in the art without departing from the scope of the invention set forth in the claims. For example, as standards evolve, or as frequencies and passbands change, as well as different topologies emerge as a result of new and better driver IC's, the utility of the approach described herein will become more evident. Such approach, as described above, offers improved performance of EMI suppression, saving PCB space, and allows the use of standard off-the-shelf RJ-45 connectors. Advantageously, this approach may be applied to any of the evolving LAN specifications, typically requiring the transmission of signals between connected devices having frequencies of anywhere from 1 to 1000 MHz, or higher, and may be applied to circuit configurations having a different turns ratio and component values than is shown above in Table 1.

What is claimed is:

1. In a connector module, comprising housing having a plug-receiving opening opposed top and bottom surfaces joined by opposed side surfaces extending from said opening to a back surface and a plurality of elongated contacts mounted to the housing, each contact including a contact portion at one end extending diagonally into the opening, and a connecting portion electrically coupling the contact portion through protection/filtering circuitry contained within said housing to at least one of a plurality of pins that protrude from a bottom surface of said housing, the improvement wherein said protection/filtering circuitry includes at least one ferrite core and is mounted within vertical space within the housing between the plug-receiving opening and the bottom surface of said housing.

2. The connector module of claim 1 wherein the improvement further includes a plurality of said plug-receiving openings (16) within the same modular jack assembly, each of the same type, each having contact portions (17) that extend diagonally into their respective opening, and each having connecting portions that electrically couple the contact portion through protection/filtering circuitry (26) to at least one of the plurality of pins (22) protruding from the bottom surface of said housing.

3. The connector module of claim 2 wherein at least two of said plug-receiving openings are stacked vertically within said housing.

4. The connector module of claim 3 wherein the bottom portion of said housing through which said plurality of pins protrudes defines a footprint area adapted to mount on and contact a printed circuit board, said footprint area comprising an area having a depth no greater than about 5.1 mm and a width no greater than about 18.2 mm.

5. The connector module of any of claims 4 wherein said plug-receiving opening is designed to receive an RJ-45 jack.

6. A connector module for mounting on a circuit board, said connector module comprising:

a housing;

at least one plug-receiving opening for receiving an RJ-45 jack, including contact portions for making electrical contact with individual conductors associated with said RJ-45 jack;

a plurality of connection pins protruding form a bottom surface of said housing adapted for insertion into the circuit board; and protection/filtering circuitry mounted within said housing between the at least one plug-receiving opening and the bottom surface of said housing for electrically coupling the contact portions associated with each plug-receiving opening to at least one of the plurality of connection pins;

said protection/filtering circuitry including at least one ring-shaped ferrite core having two or more wires separately wound therearound.

7. The connector module of claim 6 wherein said protection/filtering circuitry is positioned within vertical space within said housing so as to minimize the electrical distance between the protection/filtering circuitry and said connection pins.

8. The connector module of claim 6 wherein said protection/filtering circuitry is positioned within vertical space within said housing so as to minimize the electrical distance between the contact portions of said plug-receiving opening and said protection/filtering circuitry.

9. The modular jack of claims 8 wherein said modular jack includes two plug-receiving openings arranged vertically so that one opening resides above the other.

10. The modular jack of claims 8 wherein said modular jack includes four plug-receiving openings arranged horizontally.

11. In a connector module, comprising a housing having a plug-receiving opening, opposed top and bottom surfaces joined by opposed side surfaces extending from said opening to a back surface and plurality of elongated contacts mounted to the housing, each contact including a contact portion at one end extending diagonally into the opening, and a connecting portion electrically coupling the contact portion through protection/filtering circuitry contained within said housing to at least one of a plurality of pins that protrude from a bottom surface of said housing the improvement wherein said protection/filtering circuitry includes at least one ferrite core and is mounted within vertical space within the housing between the plug-receiving opening and the bottom surface of the housing;

shielding means are employed to electrically shield a shielded volume comprising the plug-receiving opening and protection/filtering circuitry; and light emitting means are included as part of the connector module, but are mounted for viewing so as not to be located within the shielded volume.

12. A connector module for mounting to a circuit board, said connector module comprising:

a shielded housing;

at least one plug-receiving opening for receiving an RF-45 jack, including contact portions for making electrical contact with individual conductors associated with said RJ-45 jack;

a plurality of connection pins protruding from a bottom surface of said housing adapted for insertion into the circuit board;

protection/filtering circuitry within said shielded housing between the at least one-plug receiving opening and the bottom surface of the housing for electrically coupling the contact portions associated with each plug-receiving opening to at least one of the plurality of connection pins; and light emitting means included as part of said connector module, but mounted for viewing so as not to be located within the shielded housing.

13. The connector module of claim 12 wherein said light emitting means comprises a plurality of surface mounted light emitting diodes.

14. The connector module of claim 13 wherein said surface mounted light emitting diodes are mounted towards a rear side of, but still outside of, the shielded housing; and further including viewing ports along a front side of the shielded housing; and light coupling means for coupling light emitted by each of said light emitting diodes to respective ones of the viewing ports.

15. The connector module of claim 14 wherein said light coupling means comprises a light pipe for each one of said light emitting diodes, a first end of each light pipe being positioned near a respective one of the light emitting diodes, and a second end of each light pipe being positioned to open into a respective one of the viewing ports.

16. A connector module for mounting to a circuit board, said connector module comprising:

a shielded housing;

a plurality of vertically-stacked plug-receiving openings, each for receiving an electrical jack, including contact portions for making electrical contact with individual conductors associated with said electrical jack;

a plurality of connection pins protruding from a bottom surface of said shielded housing adapted for insertion into the circuit board; and isolation/filtering circuitry within said shielded housing for electrically coupling the contact portions associated with each plug-receiving opening to at least one of the plurality of connection pins, wherein isolation components for all of the plurality of plug-receiving openings are placed near the connection pins between the bottom surface of said shielded housing and the plug receiving opening closest to the bottom surface of said shielded housing, and wherein filtering components for each of the plurality of plug-receiving openings are placed proximate the respective plug-receiving opening.

17. The connector module of claim 16 wherein the electrical jack received within each of said vertically-stacked plug-receiving openings comprises an RJ-45 jack.

18. The connector module of claim 16 wherein the isolation/filtering circuitry corresponding to each of the plurality of vertically-stacked plug-receiving openings resides in a respective removable submodule that is removably insertable within said housing.

19. The connector module of claim 18 wherein each of the removable submodules comprises a shielded submodule adapted to reduce cross-talk between signals passing through adjacent vertically-stacked plug-receiving openings.

* * * * *